US009752350B2

(12) United States Patent
Davis

(10) Patent No.: US 9,752,350 B2
(45) Date of Patent: Sep. 5, 2017

(54) HAND AND FINGER PROTECTOR FOR USE WITH DOORS

(71) Applicant: Raymond E Davis, Dallas, TX (US)

(72) Inventor: Raymond E Davis, Dallas, TX (US)

( * ) Notice: Subject to any disclaimer, the term of this patent is extended or adjusted under 35 U.S.C. 154(b) by 78 days.

(21) Appl. No.: 14/568,482

(22) Filed: Dec. 12, 2014

(65) Prior Publication Data

US 2016/0168904 A1 Jun. 16, 2016

(51) Int. Cl.

| | |
|---|---|
| ***E05B 15/02*** | (2006.01) |
| ***E05B 17/00*** | (2006.01) |
| ***E06B 7/36*** | (2006.01) |
| ***E05B 63/00*** | (2006.01) |
| *E05B 65/06* | (2006.01) |
| *E05F 5/00* | (2017.01) |

(52) U.S. Cl.

CPC ..... *E05B 17/005* (2013.01); *E05B 17/00* (2013.01); *E05B 63/00* (2013.01); *E06B 7/36* (2013.01); *E05B 65/06* (2013.01); *E05F 5/00* (2013.01)

(58) Field of Classification Search

CPC ..... Y10T 16/61; Y10T 16/615; Y10T 16/625; Y10T 16/628; Y10T 16/6285; Y10T 292/34; Y10T 292/37; Y10T 292/394; Y10T 292/397; Y10T 292/68; Y10T 292/683; Y10T 292/685; Y10T 292/688; Y10T 292/691; Y10T 292/71; Y10T 292/73; Y10T 292/694; E05F 5/00; E05F 5/02; E05F 5/022; E05F 5/025; E05F 5/04; E05F 5/06; E05C 17/00; E05C 17/005; E05C 17/02; E05C 17/46; E05C 17/48; E05C 17/54; E05C 17/047; E05C 19/18; E05C 19/188; E06B 7/36; Y10S 292/56; Y10S 292/57; E05B 65/06

USPC ..... 292/340

See application file for complete search history.

(56) References Cited

U.S. PATENT DOCUMENTS

| | | | | |
|---|---|---|---|---|
| D34,243 S * | 3/1901 | Taylor | D8/344 | |
| 2,203,333 A * | 6/1940 | Gottlob | E05C 17/04 292/262 | |

(Continued)

FOREIGN PATENT DOCUMENTS

| | | | |
|---|---|---|---|
| EP | 1035292 A1 * | 9/2000 | E05B 15/10 |
| GB | 2338743 A * | 12/1999 | E05B 15/0205 |

*Primary Examiner* — Alyson M Merlino

(74) *Attorney, Agent, or Firm* — Baker Law Firm; John Gregory Baker; Jeffrey Reddy

(57) ABSTRACT

This invention relates to an apparatus and to a method designed to prevent hand and finger injuries resulting from inadvertent door closures. The apparatus for use with an existing door and door surround includes a door latching mechanism mountable to the door having a reversibly extendable bolt actuated by a turning member, a striker member mountable to the door surround wherein a portion of the striker member projects beyond the door surround, and when the bolt is extended, complete door closure is impeded by the projecting portion of the striker member with a gap width created between the leading edge of the door and the door surround sufficient to protect human hands and fingers from being crushed, injured, or amputated. When the bolt is intentionally retracted complete door closure is permitted. The apparatus is designed to be interchangeable with standard sized door knobs, latching mechanisms, lock assemblies, and striker plates.

15 Claims, 6 Drawing Sheets

(56) References Cited

U.S. PATENT DOCUMENTS

| | | | | |
|---|---|---|---|---|
| 2,401,854 | A * | 6/1946 | Berry, Jr. | E05B 15/0245 292/341.19 |
| 2,446,206 | A * | 8/1948 | Beckman | E05B 15/0255 292/341.12 |
| 2,480,701 | A * | 8/1949 | Bradbury | E05B 17/005 16/86 A |
| 2,946,614 | A * | 7/1960 | Russell | E05B 15/0205 292/341.11 |
| 3,172,168 | A * | 3/1965 | Suska | E05F 5/04 16/82 |
| 3,862,774 | A * | 1/1975 | Johnson | E05B 65/06 16/82 |
| 3,946,460 | A * | 3/1976 | Johnson | E05B 65/06 16/82 |
| 3,967,845 | A * | 7/1976 | Governale | E05B 15/0205 292/340 |
| 4,045,065 | A * | 8/1977 | Johnson | E05B 63/24 292/341.12 |
| 4,216,986 | A * | 8/1980 | McNinch | E05C 17/50 16/82 |
| 7,155,776 | B2 | 1/2007 | Park | |
| 7,281,300 | B2 | 10/2007 | Andersen et al. | |
| 7,331,617 | B2 | 2/2008 | Johnson | |
| 7,416,230 | B2 | 8/2008 | Konstantakis et al. | |
| 7,537,250 | B1 | 5/2009 | Gustafson | |
| 8,491,020 | B2 * | 7/2013 | Lopes | E05C 3/042 292/1 |
| 2003/0070256 | A1 | 4/2003 | Kuwica | |
| 2011/0067205 | A1 * | 3/2011 | Wing | E05F 5/06 16/86 A |

* cited by examiner

HAND AND FINGER PROTECTOR FOR USE WITH DOORS

CROSS-REFERENCE TO RELATED APPLICATION

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

FIELD OF THE INVENTION

This invention pertains or relates to the field of door safety.

BACKGROUND OF THE INVENTION

It has been reported that according to the National Safety Council—Injury Facts 2011 Edition; U.S. Consumer Product Safety Commission's National Electronic Injury surveillance system that approximately 380,800 door related injuries occur in the United States ever year. Shockingly, statistics show that door related injuries occur at a rate of 31,000 month, 1,000 every day, 42 every hour and 1 every 1.4 minutes. According to one study; Clinical Pediatric Study: "Children Treated in the United States Emergency Departments for Door-related Injuries, 1999-2008", approximately eighty percent of door-related injuries occur to children in the home and approximately forty two percent of these children were under the age of four. Of these injuries, forty two percent occur at the leading edge of the door. Thousands of children each year are sent to the hospital with fractures or broken bones because their fingers were caught in slamming doors.

Door injuries are very serious, disastrous, and potentially life changing. Amputations are a triple threat involving loss of function, loss of sensation, and loss of body image causing postoperative complications such as psychological problems, phantom pain, adverse emotional health, and needed psychosocial support. Individuals who earn their living from motor skills are especially vulnerable to amputations. Youth are particularly sensitive to peer acceptance and rejection. Amputation in the preadolescent or adolescent age group is a great threat to emerging sexual identity. The elderly are also likely to have fingers amputated in doors as many times they lose their awareness of surroundings, and balance. Elderly amputees are at a greater risk for psychiatric disturbances such as depression, social isolation, new financial stringencies, and occupational limitations with complicate the adjustment to serious door hand injuries or finger amputations.

The true incidence of door-related injuries is underestimated because not all door-related injuries are treated in hospital Emergency Departments and urgent care centers do not report statistics. Of the reported cases, tens of thousands of door injuries result in finger amputations to children. The inventor believes one door injury is too many. Embodiments of the present invention can prevent these injuries.

The present invention will not only prevent little finger door amputations and hand injuries by unintended door closings, but will mitigate real potential legal and financial liability to many public and private facilities. There are many potential legal theories under which these public and private facilities having known and foreseeably unsafe doors can be found liable including: premises liability, landowner-occupier duties, general negligence, attractive nuisance doctrine, and products liability. For example, under the attractive nuisance doctrine, where the trespass of a child is likely, a landowner owes a duty to exercise ordinary care to avoid a reasonable foreseeable risk of harm posed by dangerous artificial conditions, which result from the child's inability to appreciate the risk of harm. Many heavy commercial doors in commercial buildings readily attract children. Some of these doors and door surrounds have attractive shinny metallic finishes or bright colored paint baiting the eyes and fingers of child. Doors are easily accessible to the exploring fingers of young children who are unaware and cannot appreciate the dangerous condition.

For at least the foregoing reasons, there is a need for a door safety closure device that will prevent hands and fingers from being crushed, injured, or amputated between the leading edge of the door and door surround. Moreover, the invention will prevent the economic loss of serious door injuries resulting from loss of livelihood, increased government disability payments, and diminished functional capacity of the amputees. Further, the invention will mitigate financial and legal liability that is created under legal causes of action filed under premise liability, landowner-occupier liability, general negligence, attractive nuisance doctrine, or products liability law suits.

DESCRIPTION OF PRIOR ART

Major problems facing current users of door safety closure prevention devices is that such devices require modifications to door or door frame construction and do not provide a stable gap width between the leading edge of the door and the door surround sufficient to prevent hands and fingers from being crushed, injured, or amputated. Moreover, many door safety closure prevention devices are just movable stops that many times get displaced from their original intended position and fail to prevent a door from closing.

SUMMARY

The present invention is directed to a hand and finger door protector for residential or commercial doors that will protect hands and fingers from being crushed, injured, or amputated between the leading edge of the door and door surround by the unintended slamming or closing of the door. The embodiments of the invention are designed to be interchangeable with standard door handles, door knobs or dead bolt recesses, latching mechanisms, lock assemblies, and striker plates providing for easy and quick installation.

The apparatus and method disclosed herein prevents injury to body parts resulting from door closure. Impacts of a slamming door can produce 40 tons of pressure per square inch. The apparatus and method described herein achieve the injury prevention by the steps of providing a door frame and a door having a reversibly extendable door lock bolt actuated by a handle; and, at least retraction of the lock bolt requiring intentional rotation of the handle. When the lock bolt is extended, the door is placed in a closure impeded state that produces a gap possessing a width sufficient to prevent door impact injury to hands or fingers placed in the gap. Sufficient gap width is achieved through a striker member mountable on the door surround wherein a portion of the striker member projects beyond the door surround, and when the bolt is extended, complete door closure is impeded by the striker member which stops the progression of the bolt and the door producing a gap between the leading edge of the door and the door surround that has a width sufficient to protect hands and fingers from being crushed, injured, or amputated.

Retracting the bolt requires active manipulation of a handle such as a knob, or lever in which the handle is fully turned to its limit in order to retract the lock bolt sufficiently to close the door. When the lock bolt is normally extended, in the default position, the bolt will not retract merely from forces acting on the distal end of the bolt; e.g., axial or tangential forces that are produced when the bolt contacts a strike plate. This contrasts with common latch-style locks possessing a latch tube assembly with a spring mechanism that maintains the bolt in a normally extended position except when the bolt is moved over and against the curved surface of a conventional strike plate which pushes the bolt into the body of the door.

Factors and Aspects of the Invention

The inventor is not aware of existing hand and finger door safety devices such as that described herein having a cooperating door locking mechanism and striker members mountable to the door.

In one aspect, embodiments of this invention include latching mechanisms and striker members that are interchangeable with standard sized door knobs, dead bolt holes, latching mechanisms, lock assemblies, and conventional striker plates which provides for easy and quick installation. Regarding the door and door frame for which installation is intended, excepting the special hardware described in embodiments of the invention, no material removal or additions to the door or door frame are required outside of customary practice for installing a conventional lock and strike plate.

In a second aspect, embodiments of the latching mechanism require at least intentional manipulation; e.g., turning of the handle to make certain that the handle fully retracts the reversible bolt for door closure.

In a third aspect, the hand and finger protector is designed so that the handle or other handle and the striker member cooperate together to achieve the best advantage of ensuring that a sufficient gap width to protect hands and fingers is formed between the leading edge of the door and the door surround. Moreover, embodiments of the invention are sold and packaged together.

In a fourth aspect, embodiments may include force distributing and dissipation means such as a bumper portion or projecting portions for insertion into a door frame to dissipate the impact of the door when the lock bolt of the door impacts portions of the striker member.

In a fifth aspect, common to the embodiments, the reversibly extendable door lock bolt is as long as it can be while still fitting in a bolt recess of customary depth as are found in residential and commercial door frames. Thus, the reversibly extendable door lock bolt will possess a throw length longer than current reversibly extendable latch-style bolts that are commercially available, which on average extend ½ inch beyond the face plate of the latch tube assembly.

It is intended that any aspect, object or feature may be combined with any other aspect, object or feature described herein. Embodiments of the invention, the details and features of which are shown in the drawing figures and detailed description that follow will reduce the risk of hand and finger injuries and amputations, lessen the economic loss of serious door injuries due to loss of livelihood, lessen government disability payments, prevent amputation and the sequela of diminished functional capacity of the amputees and reduce the risk of legal causes of action against premises having foreseeably dangerous doors.

The foregoing and other objects, features, and advantages of the invention will become more apparent from the following detailed description, which proceeds with reference to the accompanying figures wherein the scale depicted is approximate.

BRIEF DESCRIPTION OF THE DRAWING FIGURES

Figure 4A:
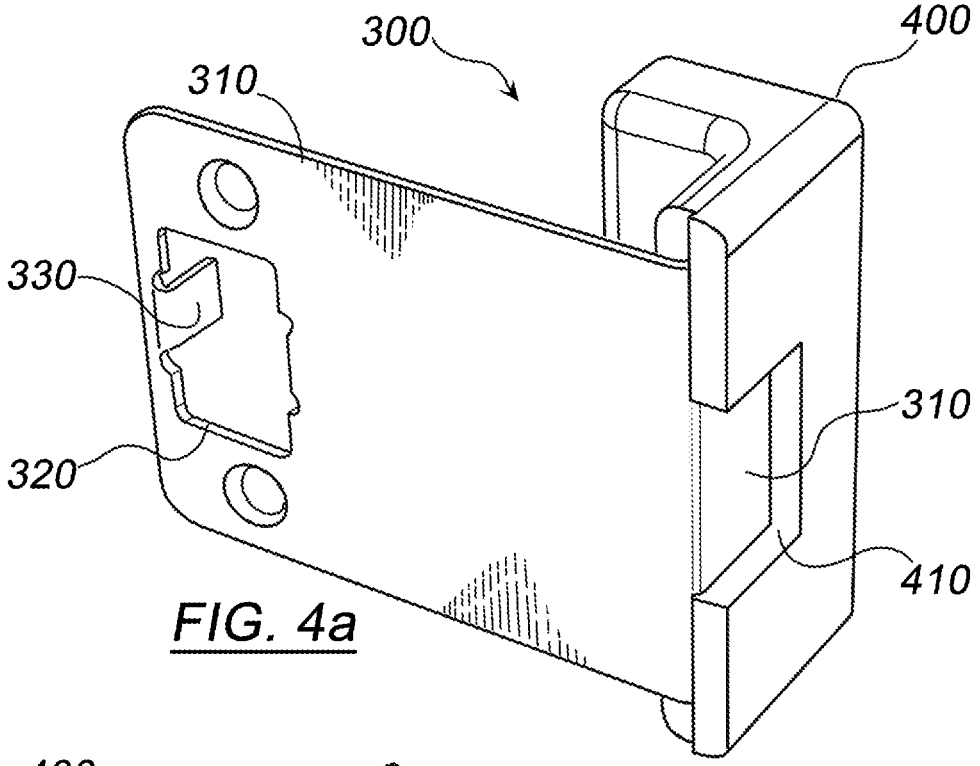
Figure 4B:
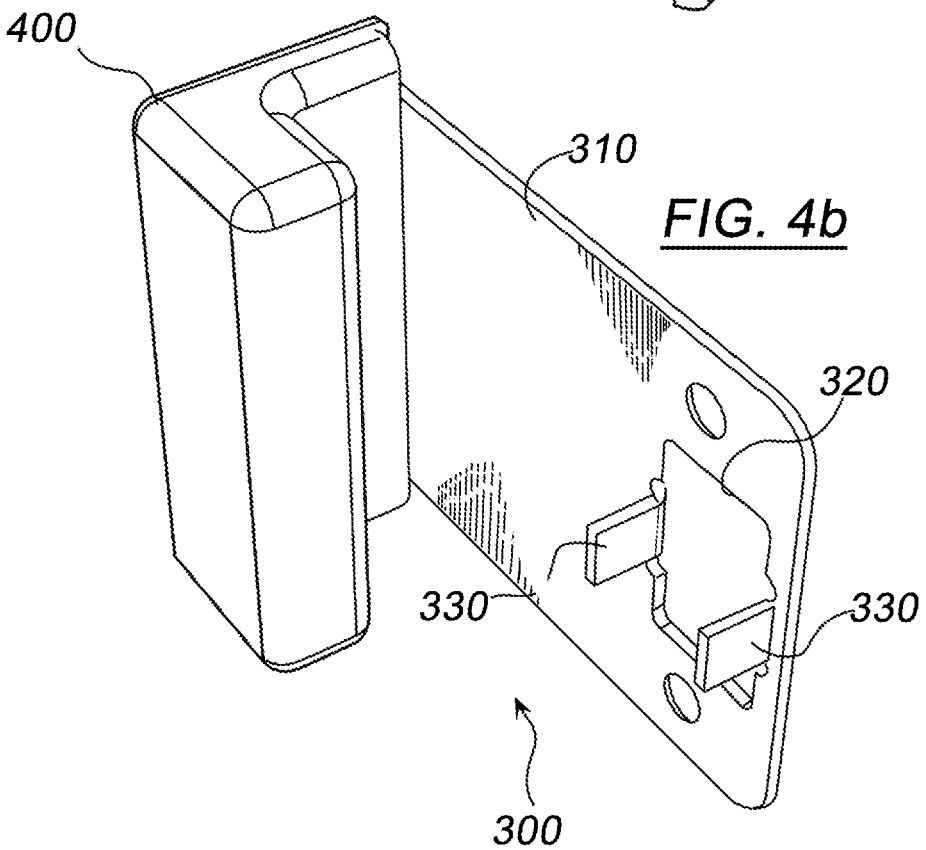
Figure 5:
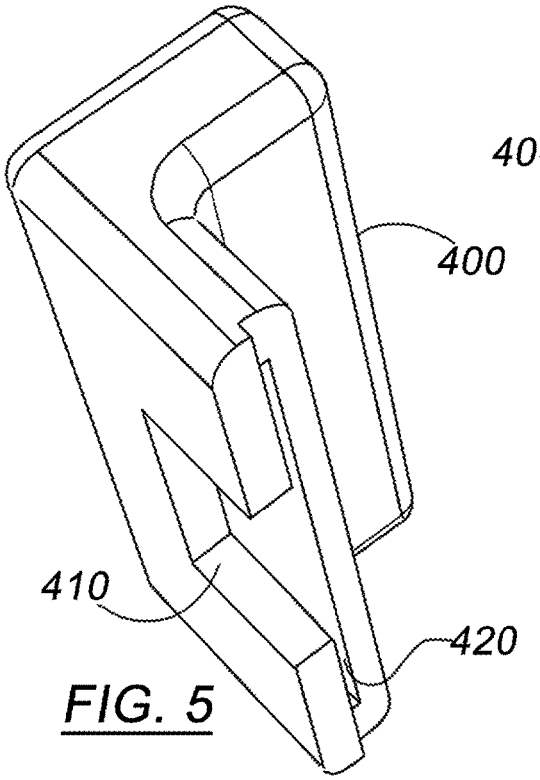
Figure 6:
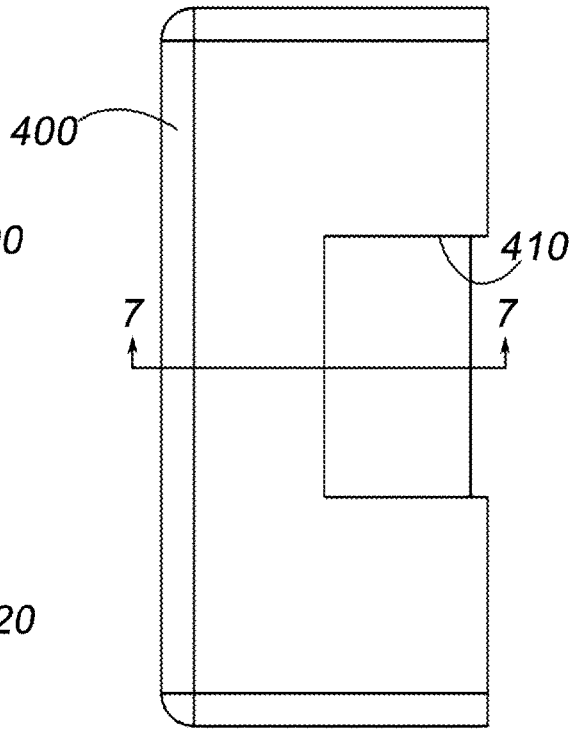
Figure 7:
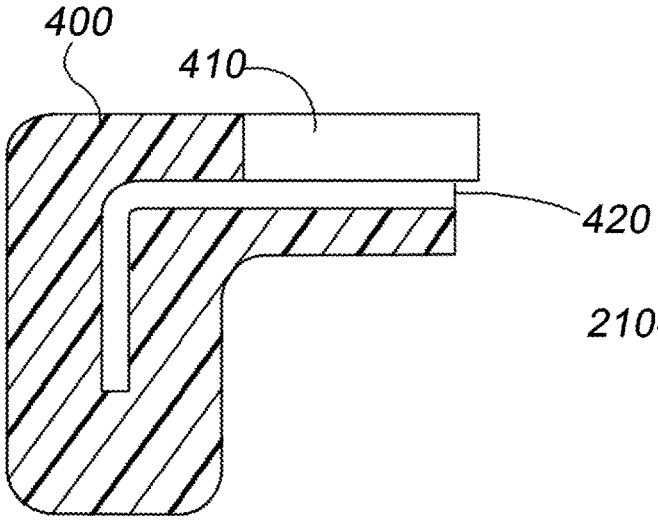
Figure 8:
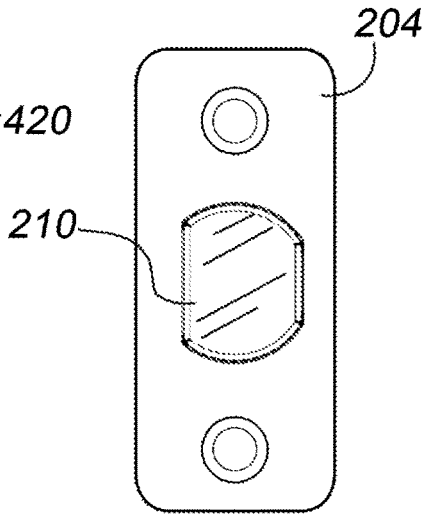
Figure 9:
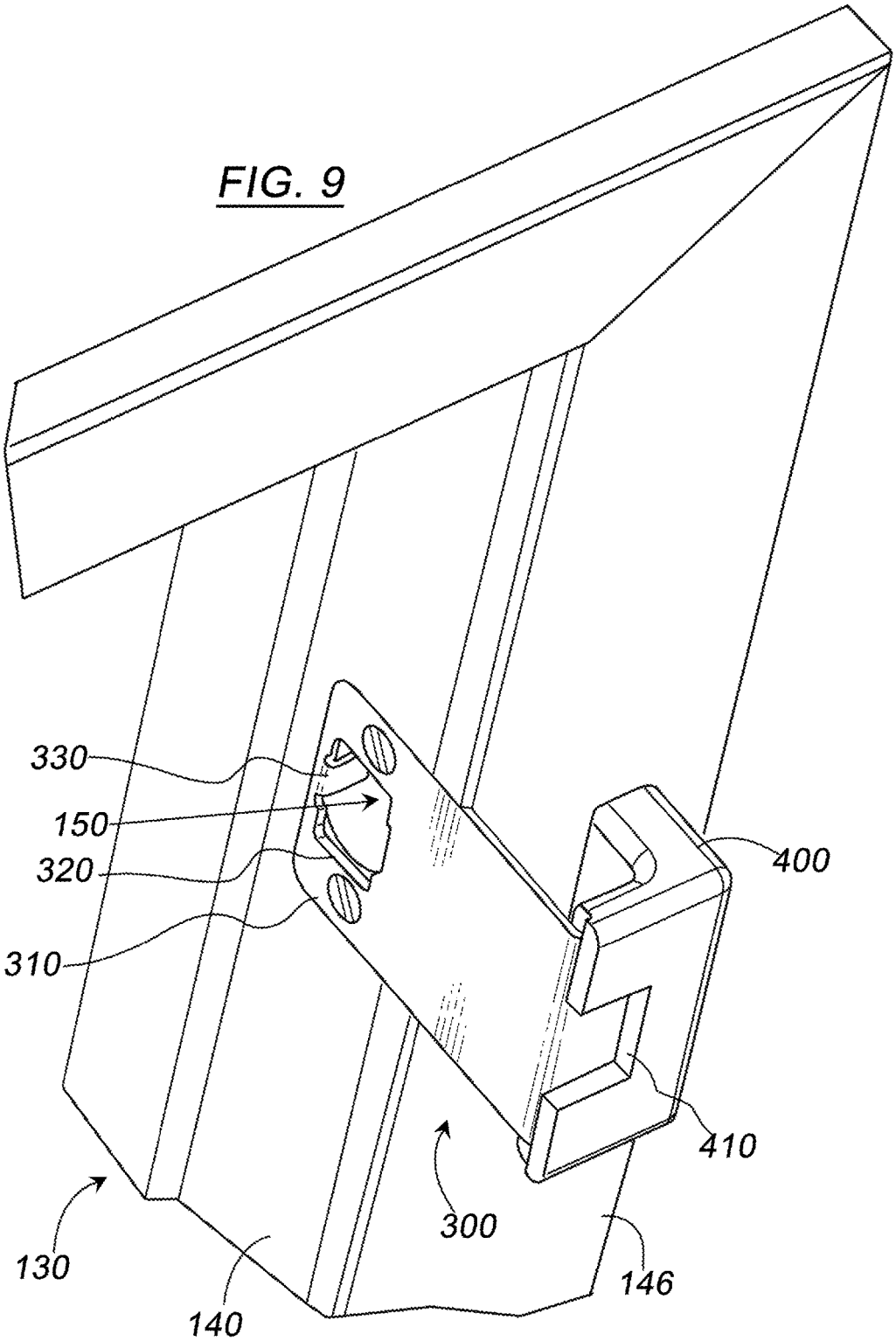
Figure 10:
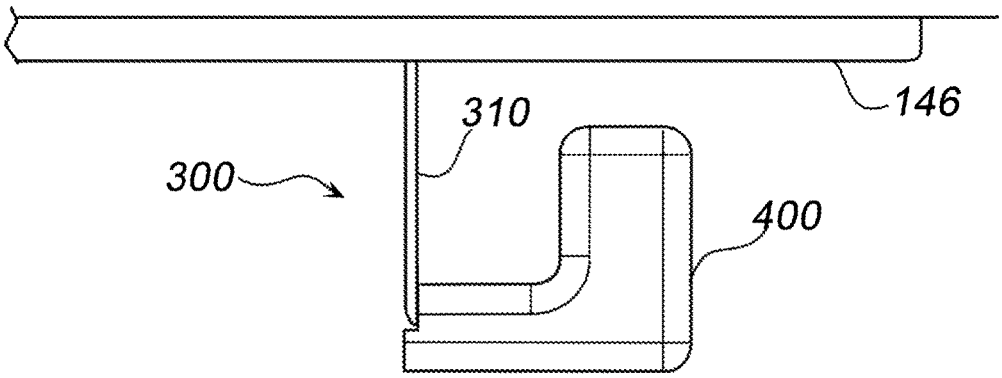
Figure 11:
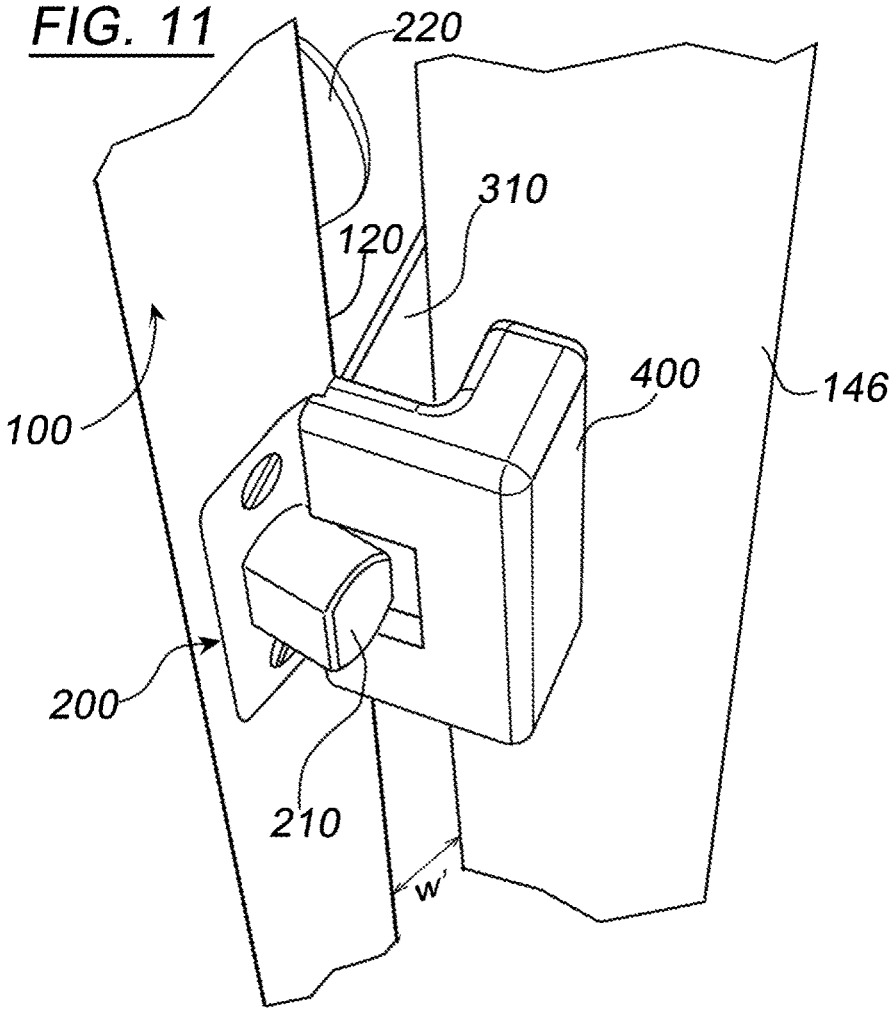
Figure 12:
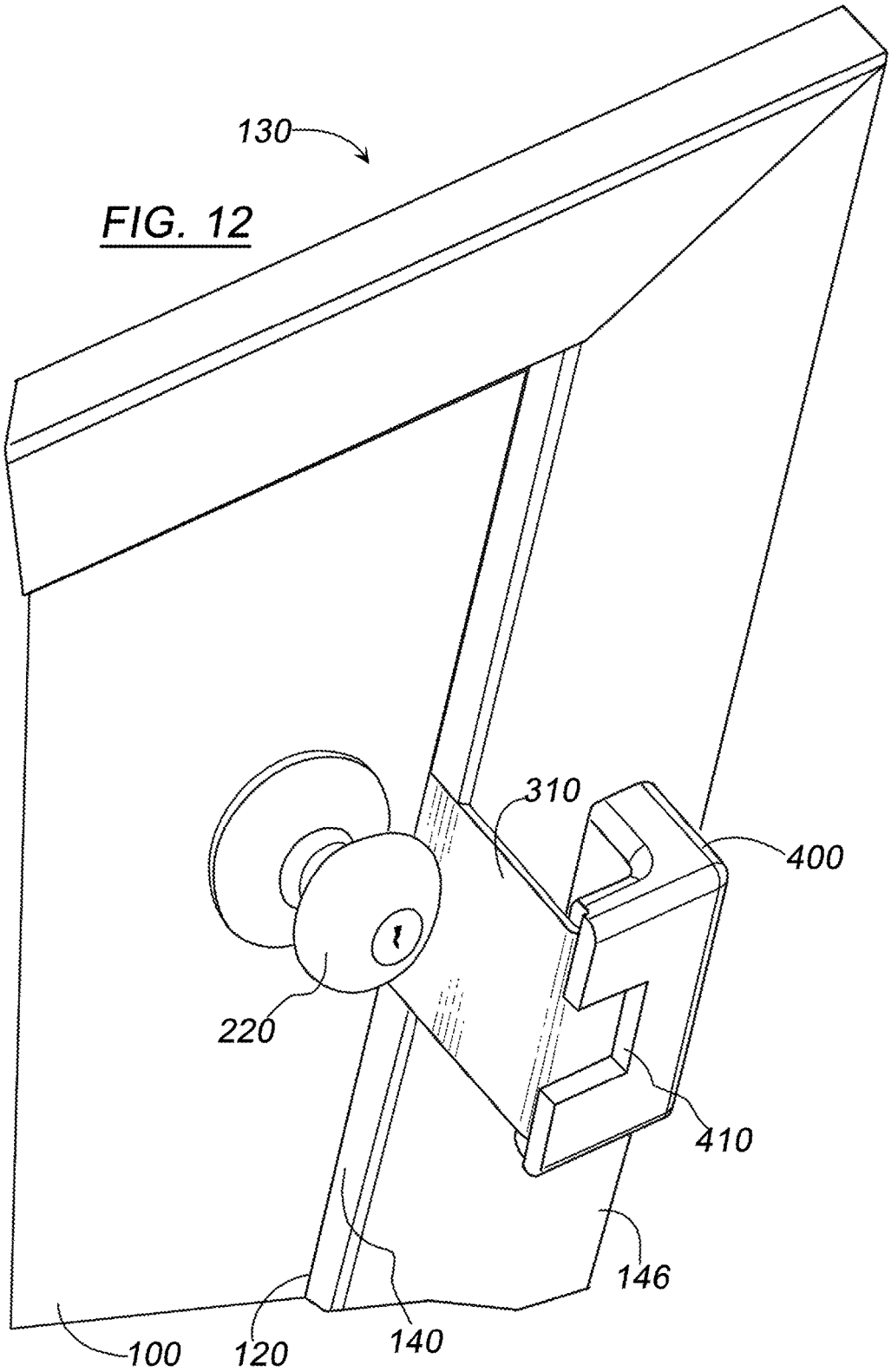

FIG. 4*a* is a perspective view showing a striker member;

FIG. 4*b* is a perspective view of a side opposite that shown in (FIG. 4);

FIG. 5 is a perspective view of a bumper portion according to an embodiment of the present invention;

FIG. 6 is a side elevation thereof;

FIG. 7 is a cross-sectional view of (FIG. 6) taken in the direction of arrows 7-7;

FIG. 8 depicts an exemplary end profile for a lock bolt according to an embodiment of the present invention;

FIG. 9 depicts an exemplary installation according to an embodiment of the present invention;

FIG. 10 is a side view of the exemplary installation depicted in (FIG. 9);

FIG. 11 in a exemplary installation, depicts the relationship between a leading edge of a door, the striker member and door surround;

FIG. 12 in an exemplary installation, depicts a door in a closed state relative to the striker member.

REFERENCE LISTING OF THE NUMBERED ELEMENTS

100 door
120 door leading edge
130 door surround
140 door frame
146 door casing
150 bolt recess
200 lock assembly
210 lock bolt
220 handle
300 striker member
310 striker plate
320 bolt aperture
330 recess flange
400 bumper portion
410 cut-out
420 slot

Definitions

In the following description, the term "door" as used herein, includes pivoting or hinging panels that are designed to occlude an opening. The term "complete door closure" as used herein, means the door is substantially flush with a door surround and wherein there is minimal gap between the edge of the door and the door frame while still permitting the door to transition between an open and closed position. The term "door surround" as used herein, means the structure surrounding a door, whether outward facing or inward facing, and includes raised molding; e.g., casing, or other non-raised surface; e.g., wall or cabinetry surfaces directly adjacent to, or abutting the door's edge(s). The term "door frame" as used herein, refers to portions of the door surround that are typically at a right angle relative to the facing plane of the door when the door is shut. The term "leading edge" as used herein, refers to that portion of a door that leads when the door is being moved from an open to closed position; e.g., the lock stile portion of a rail and stile door. The term "lock" as used herein, means a door lock including at least a latch tube assembly having an internal spring, a normally extended bolt, and means for actuating the bolt which may be, but is not limited to a handle, a key or a knob. The term "latch type bolt" as used herein, means bolts that are typically spring loaded wherein the bolt is in a normally extended position, but where the distal end of the bolt is tapered or angled. The term "lock type bolt" or "lock bolt" as used herein, means bolts that are not typically spring loaded, such as deadbolts that require extension or retraction by actuation of a key or knob, and that typically possess a distal end that is flat rather than angled. The term "conventional strike plate" when used herein, refers to plates inset into door frames, normally of stamped steel, having an aperture for receiving a bolt and which may or may not include a curved lip whereby a latch type bolt is compressed when moved thereagainst, and then guided to a bolt recess. The term "handle" as used herein, refers to a manipulatable actuator for retracting or extending a latch or lock style bolt which extends to knobs, levers and other actuators. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-12, embodiments for a hand and finger protector and method for preventing injuries resulting from impact with a leading edge 120 of a door 100 include, a striker member 300 adapted to be interchangeable with a conventional striker plate when mounted to a door surround; the striker member including a striker plate 310 having a lock bolt aperture 320 and projecting portion(s) for insertion into a lock bolt recess of a door frame. Additionally, the striker plate may include a bumper portion 400 at an end of the striker member extending beyond the door surround. Bumper 400 may include an elastomeric or resilient material and extend beyond a door casing 146 when striker member 300 is mounted to a door surround 130.

Striker member 300 may be paired with a special door lock having a reversibly extendable lock bolt 210 that must be at least retracted by moving a handle 220, and which will not retract passively when axial or tangential force is applied directly to the projecting end of the lock bolt. In cases where the bolt is normally extended, a compression spring extends the bolt, but the bolt is prevented from retracting unless the handle is actively rotated, turned or levered. While door lock mechanisms of varying design may be selected by those having skill in the art and access to this disclosure for use with embodiments described herein, a latch tube assembly with a compression spring loaded bolt may be used wherein the spring is selected to be sufficiently stiff to resist the typical axial and tangential forces applied to the distal end of the lock bolt when abutting the striker plate. In any case, the lock bolt possesses a throw length sufficient to abut an edge of the striker plate 310 when pushed thereagainst. Accordingly, the reversibly extendable door lock bolt will possess a throw length at least 1/16 inch longer than typical reversibly extendable latch-style bolts, which on average extend ½ inch beyond the face plate 204 of the latch tube assembly.

The striker member 300 may be installed on an existing door 100 and door surround 130 to replace a conventional strike plate, or, may be pre-installed on pre-hung doors. In one exemplary installation, striker member is mounted to a door frame 140 in the same manner as a conventional strike plate in which a small section of door frame material is removed prior to fitment in order to flush fit striker plate 310 against the door frame and fasten it thereto by threaded fasteners. Flanges 330 of the striker member extend into a lock bolt recess 150 of a door frame 140 and are braced against inside surfaces of the lock bolt recess in order to distribute and dissipate door impacting forces when an extended lock bolt 210 of a closing door impacts portions of the striker member. Although in the particular embodiments described herein, portions of the striker member extending into the lock bolt recess are shown as flanges 330, with each projecting at substantially a right angle to the striker plate 310 of the striker member, other projecting members capable of insertion into a lock bolt recess of a door frame which are unitary with, connected to, or coupled to the striker member will suggest themselves to those having skill in the art having access to this disclosure.

Once the striker member 300 is installed to a door frame 140 and paired with a door lock having a reversibly extendable lock bolt 210 that requires active turning of a door handle 220 in order to at least retract the lock bolt and the lock bolt is in an extended position, attempts to fully close the door will be impeded when the lock bolt contacts portions of the striker member that results in a gap between the leading edge of the door and the door frame of sufficient width to prevent injury from impact in cases where a hand or fingers are inadvertently placed in the gap. In order to close the door, the lock bolt is retracted by rotating the door handle which retracts the lock bolt and permits the leading edge 120 of the door and retracted bolt to pass the striker member. Securing the fully closed door by means of the locking mechanism is the same as conventional doors having reversibly extendable lock bolts.

Figure 1:
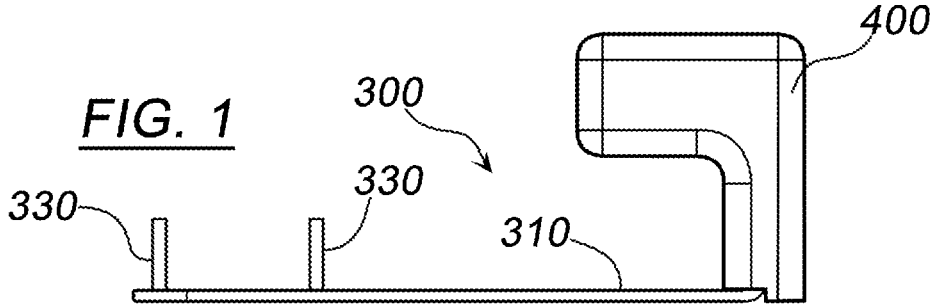
FIG. 1 is a top plan view of one embodiment according to the present invention.
Figure 2:
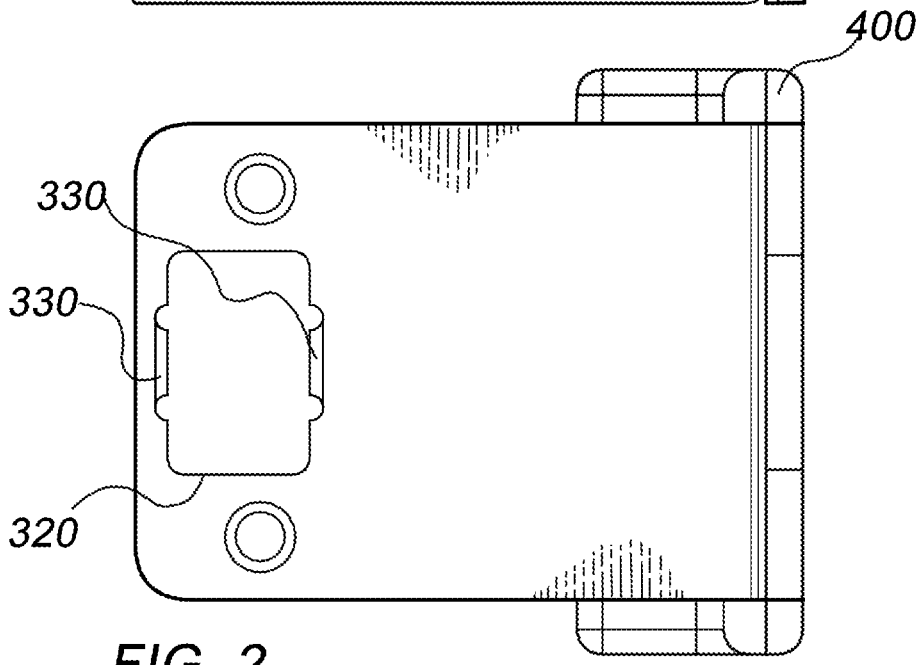
FIG. 2 is a side elevation thereof.
Figure 3:
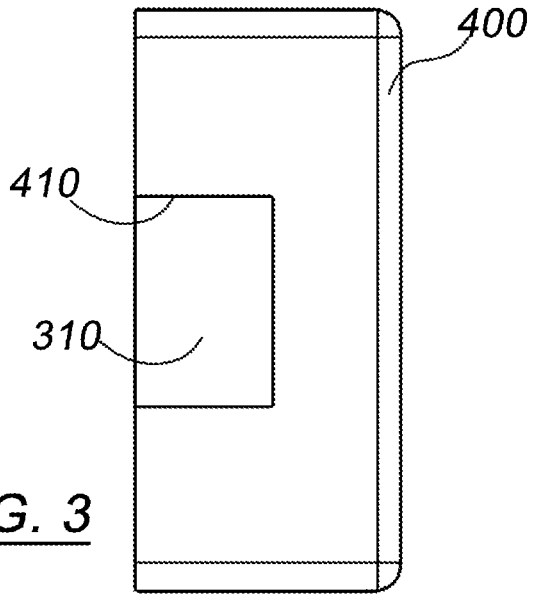
FIG. 3 is an end view thereof.

FIGS. 1-3 depict respectively, a top edge, a side elevation and an end view of a striker member 300 including a striker plate 310, a bumper portion 400, flanges 330 and a lock bolt aperture 320. The bumper portion may be a separate element coupled, to the striker plate by suitable means such as overmolding, fastening, fusing or laminating, or, one end of the striker plate may form all or portions the bumper portion. Typically, the bumper portion extends beyond the door surround with a gap formed between a rear side of the bumper portion and the door casing 130. The gap between the bumper portion and the door casing may vary depending on the particular dimensions of the bumper portion, thickness of the door casing, or other factors. In cases where the door is slammed, considerable forces are generated and the bumper portion may be rebound against the door casing to prevent damage to the door and the striker member.

FIGS. 4*a* and 4*b* are perspective views showing striker plate 310 with bumper portion 400 formed thereon. The bumper has a cut-out 410 or notch, exposing a portion of the striker plate to an impacting lock bolt 210. While preferably, the material of the striker plate is steel or brass which possesses desirable properties for its intended use, other metals or materials such as glass filled resin or elastomers may provide supplementary impact resistant properties and may be used to form portions of the striker member.

FIGS. 5-7 depict respectively, a perspective view, a side view and a cross-sectional view of bumper portion 400 taken along lines 7-7. A slot 420 or cavity is formed in the bumper portion to house an end of the striker plate (FIG. 7).

FIG. 8 is an end view showing a profile of a lock bolt suitable for use with embodiments of the invention. Preferably, the end of the lock bolt is substantially planar, but may have a small radius fillet about the perimeter, which differs from typical latch style bolts that are angled or tapered for sliding contact with a strike plate.

FIG. 9 shows an exemplary installation where the striker member 300 has been mounted to a door frame 140 by threaded fasteners. Bumper portion 400 extends beyond casing 146 of the door. Cut-out 410 exposes portions of the striker plate 310 to impact from an extended lock bolt 210. The side of the plate facing the inside of the door is substantially planar so that when the lock bolt is retracted by active turning of the handle, the leading edge 120 of the door will pass the bumper portion and may be seated within the frame, permitting the door to be shut and locked.

FIG. 10 is a side view of an exemplary installation showing an offset between the door casing 146 and bumper portion 400. It should be understood that this offset may vary according to striker plate length, the dimensions of the door frame, door casing or other factors.

FIG. 11 in an exemplary installation, depicts a door where the extended lock bolt 210 of lock 200 is contacting portions of the striker plate 310 exposed by cut-out 410. Note gap width w' which is a function of striker plate length. It is intended that the gap be of sufficient width to protect the hands and fingers of both children and adults when inadvertently placed in the gap.

FIG. 12 in an exemplary installation depicts a door 100 in a closed state relative to striker member 300. Once the door is completely closed, lock bolt 210 of the door may be extended into the lock bolt recess 150 of the door frame, thus securing the door in the closed position.

While in the embodiments depicted herein, the handle is depicted as a door knob that is rotated, it is not intended that the invention be limited to the use of bolt actuation mechanisms that are rotated in a clockwise or counter-clockwise motion. Other door handles such as sliding handles or push levers, may be contemplated. Further, the locking mechanism for fixing the position of the lock bolt may be, but is not limited to push button, keyed or turning knobs.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the scope of the following claims.

What is claimed is:

1. An apparatus comprising:

(1) a door with a lock having a lock bolt, which is normally extended, and a door surround including a door frame, and the lock bolt having a throw length and width;

(2) a striker member having a portion projecting beyond the door surround, wherein the portion projecting beyond the door surround includes a lock bolt impact backstop region with boundaries exceeding the lock bolt throw length and width, and, whereby when the door is in an open state and the lock bolt of the lock is extended, complete closure of the door is impeded when the door is moved from the open state toward a closed state by direct contact between the lock bolt and the lock bolt impact backstop region such that a gap, having a width sufficient to prevent hands and fingers from being crushed or amputated, is formed between a leading edge of the door and the door frame, and when a door handle that actuates the lock bolt is rotated or levered to its limit, the lock bolt retracts and complete closure of the door is permitted; and, (3) a bumper member located on the striker member at least behind the lock bolt impact backstop region, wherein flanges of the striker are configured to distribute and dissipate the force of the lock bolt directly contacting the lock bolt impact backstop region of the striker member, and the bumper member is configured to rebound against the door surround when the force of the lock bolt directly contacting the lock bolt impact backstop region is excessive.

2. The apparatus according to claim 1, wherein a portion of the striker member is inset into the door frame.

3. The apparatus according to claim 1, wherein the striker member replaces a conventional door frame strike plate.

4. The apparatus according to claim 1, wherein the bumper member is positioned distally on the portion of the striker member projecting beyond the door surround.

5. The apparatus according to claim 1, wherein at least the bumper member is resilient.

6. The apparatus according to claim 1, wherein the door handle and lock is installable on either side of the door.

7. A method for preventing injury to body parts resulting from door closure comprising the steps of:

providing a door with a normally extended reversibly extendable door lock bolt, and a door surround which includes a door frame;

installing a striker member on the door frame wherein the striker member includes a first portion that projects beyond the door surround, an impact region configured to receive a direct impact of the lock bolt when the lock bolt is in a normally extended position, and a bumper member located on a distal end of the first portion and behind the impact region, and the striker member is configured to impede progression of the door from an open state to a closed state when the lock bolt is in the normally extended position so as to directly contact the impact region which forms a gap between a leading edge of the door and the door frame sufficient to prevent hands and fingers from being crushed or amputated by complete closure of the door thereby placing the door in a closure impeded state and, extending or retracting the lock bolt by means of a handle to respectively place the door in the closure impeded state or to enable complete closure of the door wherein the lock bolt is received by a recess in the door frame.

8. The method according to claim 7 wherein the striker member includes an aperture that is circumjacent to the lock bolt when the lock bolt is received by the recess in the door frame.

9. The method according to claim 7 wherein the bumper portion is resilient.

10. The method according to claim 7 wherein the striker member includes portions braced against portions of the door surround to dissipate impact when the lock bolt directly contacts the impact region.

11. An apparatus for protecting hands and fingers comprising:

(1) a door lock assembly mountable to a door including a normally extended reversibly extendable lock bolt having at least a throw length and a width, and wherein the lock bolt is retractable solely by actuating a door handle;

(2) a striker member including a proximal end mountable to a door frame, a projecting portion extending from the proximal end of the striker member and extending outwardly from the door frame and having a distal end including a lock bolt impact region with bounds defining a backstop for the width and throw length of the lock bolt when the lock-type bolt is in direct contact with the lock bolt impact region whereby a gap is formed between a leading edge of the door and the door frame, and the gap is sufficiently wide to prevent hands and fingers from being crushed or amputated between the leading edge of the door and the door frame; and, (3) a bumper member behind the lock bolt impact region and bordering the lock bolt impact region, the bumper member projecting in a direction toward the door frame, and the bumper member configured to rebound against the door surround when the force of the lock bolt directly contacting the lock bolt impact region is excessive.

12. The apparatus according to claim 11, wherein complete closure of the door is impeded by the lock bolt directly contacting the lock bolt impact region impacting region.

13. The apparatus according to claim 11, wherein the striker member replaces a conventional door frame strike plate.

14. The apparatus according to claim 11, wherein portions of the striker member extend into a bolt recess.

15. The apparatus according to claim 11, wherein at least the bumper member is resilient.

* * * * *